US009765609B2

(12) United States Patent
Chemali et al.

(10) Patent No.: US 9,765,609 B2
(45) Date of Patent: Sep. 19, 2017

(54) DOWNHOLE OPTICAL IMAGING TOOLS AND METHODS

(75) Inventors: Roland E. Chemali, Humble, TX (US); Ron Dirksen, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1423 days.

(21) Appl. No.: 13/391,419

(22) PCT Filed: Sep. 24, 2010

(86) PCT No.: PCT/US2010/050094

§ 371 (c)(1), (2), (4) Date: Feb. 21, 2012

(87) PCT Pub. No.: WO2011/038170

PCT Pub. Date: Mar. 31, 2011

(65) Prior Publication Data

US 2012/0169841 A1 Jul. 5, 2012

Related U.S. Application Data

(60) Provisional application No. 61/246,115, filed on Sep. 26, 2009.

(51) Int. Cl.
*H04N 7/00* (2011.01)
*H04N 13/02* (2006.01)
(Continued)

(52) U.S. Cl.
CPC ..... *E21B 47/0002* (2013.01)

(58) Field of Classification Search
USPC ..... 348/85
See application file for complete search history.

(56) References Cited

U.S. PATENT DOCUMENTS 4,319,192 A 3/1982 Chemali et al.
4,331,975 A * 5/1982 Krawza et al. ..... 348/85
(Continued)

FOREIGN PATENT DOCUMENTS

WO WO-2011/038170 3/2011
WO 2012/039707 3/2012

OTHER PUBLICATIONS

Heysse, et al., "Field Tests of an Acoustic Logging-While-Drilling Tool in Various Borehole Environments", SPWLA 37th Annual Logging Symposium, Jun. 16-19, 1996, pp. 1-11, pp. 1-11.
(Continued)

*Primary Examiner* — Mohammad J Rahman
(74) *Attorney, Agent, or Firm* — Alan Bryson; Parker Justiss, P.C.

(57) ABSTRACT

A disclosed downhole optical imaging tool includes a light source and a camera enclosed within a tool body having at least two sidewall windows. A first window transmits light from the light source to a target region in the borehole, while a second window passes reflected light from the target region to the internal camera. The target region is spaced along the borehole away from the second window in a direction opposite the first window. In some embodiments, this configuration is provided by angling the first and second windows with respect to the sidewall, or by shaping the windows to cast and receive light from a "forward" direction. Some tool embodiments include motion and/or orientation sensors that are employed by a processor to combine separately captured images into a panoramic borehole image. It can be employed during drilling operations employing air or a substantially transparent liquid as a drilling fluid.

29 Claims, 7 Drawing Sheets

(51) Int. Cl.
*H04N 7/18* (2006.01)
*E21B 47/00* (2012.01)

(56) References Cited

U.S. PATENT DOCUMENTS

| | | | | |
|---|---|---|---|---|
| 4,646,026 | A | 2/1987 | Chemali et al. | |
| 4,745,562 | A | 5/1988 | Prazdny | |
| 4,918,669 | A | 4/1990 | Chemali et al. | |
| 5,038,107 | A | 8/1991 | Gianzero et al. | |
| 5,517,024 | A | 5/1996 | Mullins et al. | |
| 5,652,617 | A | 7/1997 | Barbour | |
| 5,663,559 | A * | 9/1997 | Auzerais et al. | 250/269.1 |
| 6,041,860 | A | 3/2000 | Nazzal et al. | |
| 6,072,314 | A | 6/2000 | Oraby | |
| 6,377,050 | B1 | 4/2002 | Chemali et al. | |
| 6,564,883 | B2 | 5/2003 | Fredericks et al. | |
| 6,600,321 | B2 | 7/2003 | Evans | |
| 6,678,616 | B1 | 1/2004 | Winkler et al. | |
| 6,850,068 | B2 | 2/2005 | Chemali et al. | |
| 6,868,036 | B2 | 3/2005 | Wang et al. | |
| 6,909,666 | B2 | 6/2005 | Dubinsky et al. | |
| 6,957,700 | B2 | 10/2005 | Mandal | |
| 6,957,708 | B2 | 10/2005 | Chemali et al. | |
| 7,063,174 | B2 | 6/2006 | Chemali et al. | |
| 7,098,664 | B2 | 8/2006 | Bittar et al. | |
| 7,099,810 | B2 | 8/2006 | Mandal | |
| 7,114,565 | B2 | 10/2006 | Estes et al. | |
| 7,161,721 | B2 | 1/2007 | Young | |
| 7,272,504 | B2 | 9/2007 | Akimov et al. | |
| 7,375,530 | B2 | 5/2008 | Chemali et al. | |
| 7,400,262 | B2 | 7/2008 | Chemali et al. | |
| 7,405,563 | B2 | 7/2008 | Kruspe et al. | |
| 7,483,793 | B2 | 1/2009 | Wang et al. | |
| 7,634,059 | B2 * | 12/2009 | Wraight | 378/89 |
| 7,705,878 | B2 | 4/2010 | Mandal et al. | |
| 7,723,991 | B2 | 5/2010 | Signorelli et al. | |
| 7,839,149 | B2 | 11/2010 | Wang et al. | |
| 7,894,990 | B2 | 2/2011 | Wang et al. | |
| 7,915,895 | B2 | 3/2011 | Chemali et al. | |
| 7,973,532 | B2 | 7/2011 | Forgang et al. | |
| 7,994,790 | B2 | 8/2011 | Itskovich et al. | |
| 8,008,919 | B2 | 8/2011 | Wang et al. | |
| 8,134,476 | B2 | 3/2012 | Chemali et al. | |
| 8,164,339 | B2 | 4/2012 | Fang et al. | |
| 8,332,152 | B2 | 12/2012 | Itskovich et al. | |
| 2004/0160514 | A1 * | 8/2004 | Tawfig et al. | 348/85 |
| 2005/0006090 | A1 | 1/2005 | Chemali et al. | |
| 2005/0078555 | A1 | 4/2005 | Tang et al. | |
| 2006/0198242 | A1 | 9/2006 | Geerits et al. | |
| 2007/0035736 | A1 | 2/2007 | Vannuffelen et al. | |
| 2009/0091320 | A1 * | 4/2009 | Flaum et al. | 324/303 |
| 2009/0147907 | A1 * | 6/2009 | Wraight | 378/1 |
| 2009/0166035 | A1 | 7/2009 | Almaguer | |
| 2010/0020638 | A1 | 1/2010 | Mickael et al. | |
| 2010/0312477 | A1 | 12/2010 | Sanstrom et al. | |
| 2011/0204217 | A1 | 8/2011 | Oraby et al. | |
| 2011/0284314 | A1 | 11/2011 | Oraby | |
| 2012/0169841 | A1 | 7/2012 | Chemali et al. | |
| 2013/0125641 | A1 | 5/2013 | Chemali et al. | |

OTHER PUBLICATIONS

PCT International Search Report and Written Opinion, dated Mar. 4, 2011, Appl No. PCT/US10/50094, "Downhole Optical Imaging Tools and Methods", filed Sep. 24, 2010, 11 pgs.

PCT International Search Report and Written Opinion, dated Nov. 2, 2010, Application No. PCT/US10/49751, "Micro-Sonic Density Imaging While Drilling Systems and Methods", filed Sep. 22, 2010, 7 pgs.

Willis, et al., "Automatic P and S Velocity Determination from Full Waveform Digital Acoustic Logs", Geophysics, V48 n12, Dec. 1983, pp. 1631-1644, pp. 1631-1644.

PCT International Preliminary Report on Patentability, dated Apr. 5, 2012, Appl No. PCT/US2010/050094, "Downhole Optical Imaging Tools and Methods", filed Sep. 24, 2010, 8 pgs.

PCT International Preliminary Report on Patentability, dated Apr. 4, 2013, Application No. PCT/US10/49751, "Micro-Sonic Density Imaging While Drilling Systems and Methods", filed Sep. 22, 2010, 4 pgs.

SG Written Opinion, dated Nov. 11, 2013, Appl. No. 201300873-5, "Micro-Sonic Density Imaging While Drilling Systems and Methods", filed Feb. 4, 2013, 13 pgs.

* cited by examiner

FIG. 1
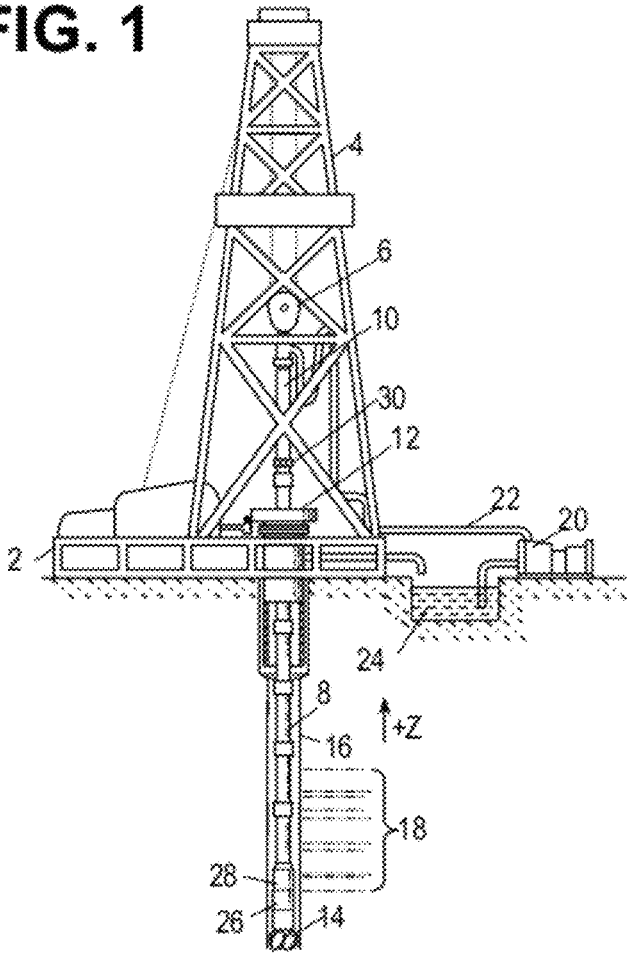
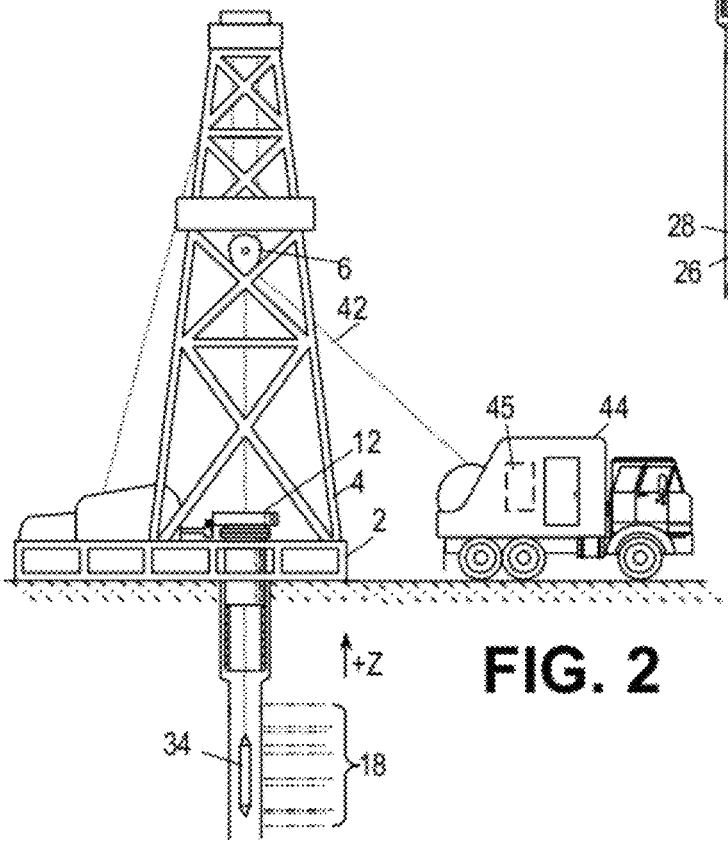
FIG. 2

FIG. 4
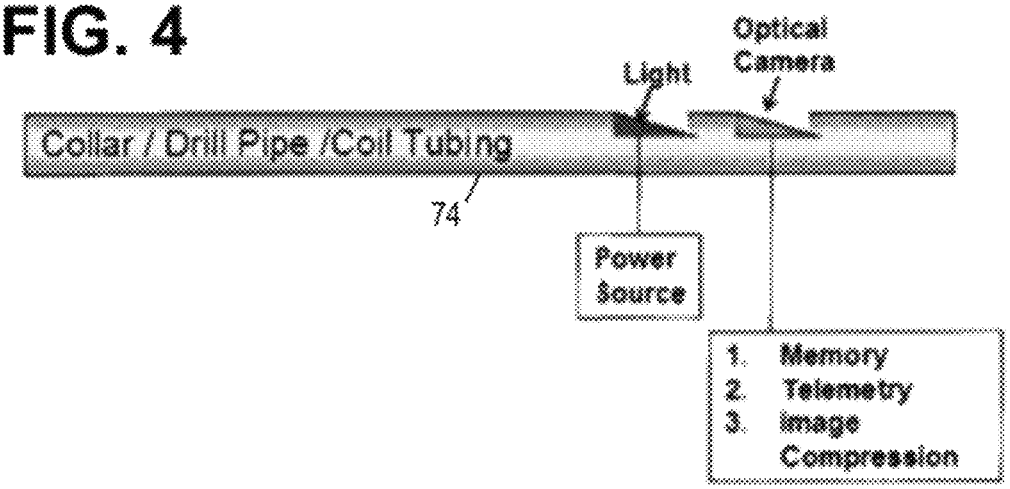
FIG. 5
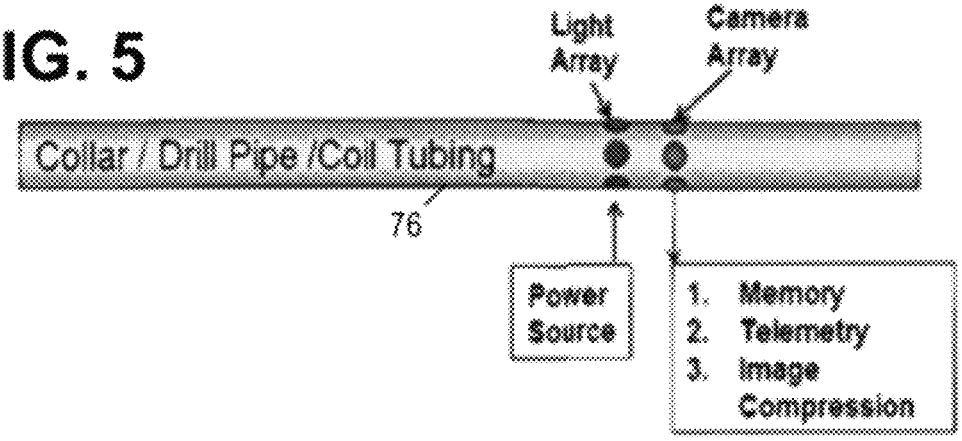
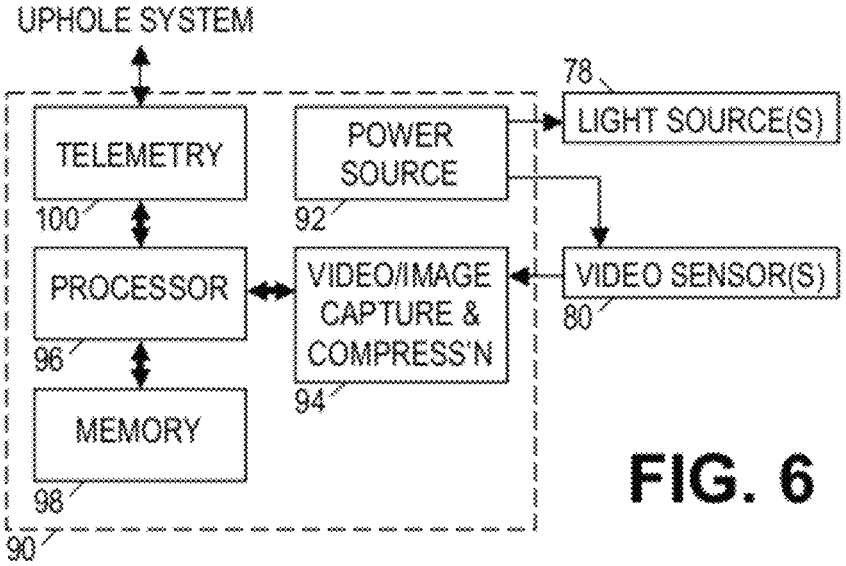
FIG. 6

FIG. 9
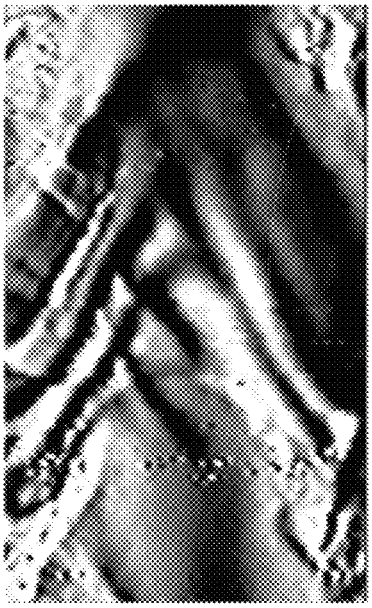
FIG. 10
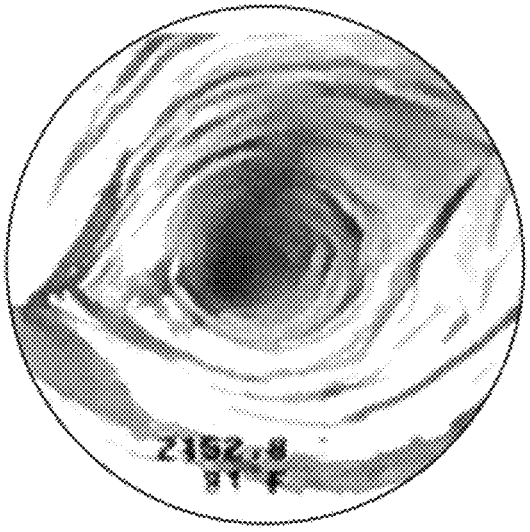
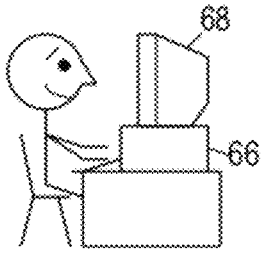
FIG. 11A
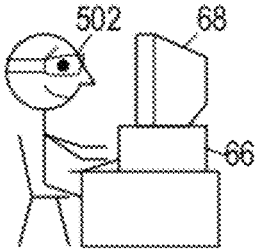
FIG. 11B
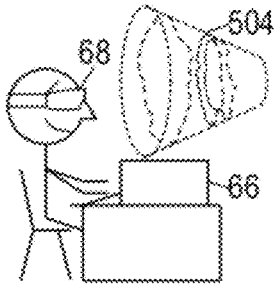
FIG. 11C
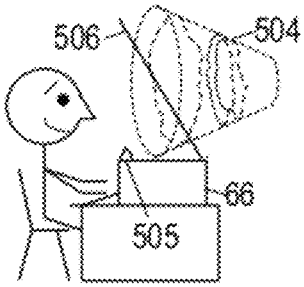
FIG. 11D

DOWNHOLE OPTICAL IMAGING TOOLS AND METHODS

CROSS-REFERENCE TO RELATED APPLICATIONS

The present application claims priority to Provisional U.S. Application No. 61/246,115, titled "Downhole Video While Drilling", and filed Sep. 26, 2009, by inventors Roland Chemali and Ron Dirksen. This provisional is hereby incorporated herein by reference.

BACKGROUND

Modern oil field operators demand access to a great quantity of information regarding the parameters and conditions encountered downhole. Such information typically includes characteristics of the earth formations traversed by the borehole and data relating to the size and configuration of the borehole itself. The collection of information relating to conditions downhole, which commonly is referred to as "logging," can be performed by several methods including wireline logging and "logging while drilling" (LWD).

In wireline logging, a probe or "sonde" is lowered into the borehole after some or all of the well has been drilled. The sonde hangs at the end of a long cable or "wireline" that provides mechanical support to the sonde and also provides an electrical connection between the sonde and electrical equipment located at the surface of the well. In accordance with existing logging techniques, various parameters of the earth's formations are measured and correlated with the position of the sonde in the borehole as the sonde is pulled uphole.

In LWD, the drilling assembly includes sensing instruments that measure various parameters as the formation is being penetrated, thereby enabling measurements of the formation while it is less affected by fluid invasion. While LWD measurements are desirable, drilling operations create an environment that is generally hostile to electronic instrumentation, telemetry, and sensor operations.

In these and other logging environments, measured parameters are usually recorded and displayed in the form of a log, i.e., a two-dimensional graph showing the measured parameter as a function of tool position or depth. In addition to making parameter measurements as a function of depth, some logging tools also provide parameter measurements (e.g., resistivity or acoustic impedance) as a function of azimuth. Such tool measurements have often been displayed as two-dimensional images of the borehole wall, with one dimension representing tool position or depth, the other dimension representing azimuthal orientation, and the pixel intensity or color representing the parameter value.

In certain environments (e.g., air-drilling operations) such tools perform poorly. Moreover, even when such tools operate normally, operators often still feel 'blind' when it comes to understanding exactly what is happening downhole.

DESCRIPTION OF THE DRAWINGS

A better understanding of the various disclosed embodiments can be obtained when the following detailed description is considered in conjunction with the following drawings, in which:

FIG. 1 shows an illustrative environment for logging while drilling ("LWD");

FIG. 2 shows an illustrative environment for wireline logging;

FIG. 4 shows a first downhole optical imaging-while-drilling tool;

FIG. 5 shows a second downhole optical imaging-while-drilling tool;

FIG. 6 is a block diagram of an illustrative downhole optical imaging tool;

FIGS. 9 and 10 show illustrative borehole wall images;

FIGS. 11A-11D show various downhole video viewing systems.

Figure 3:
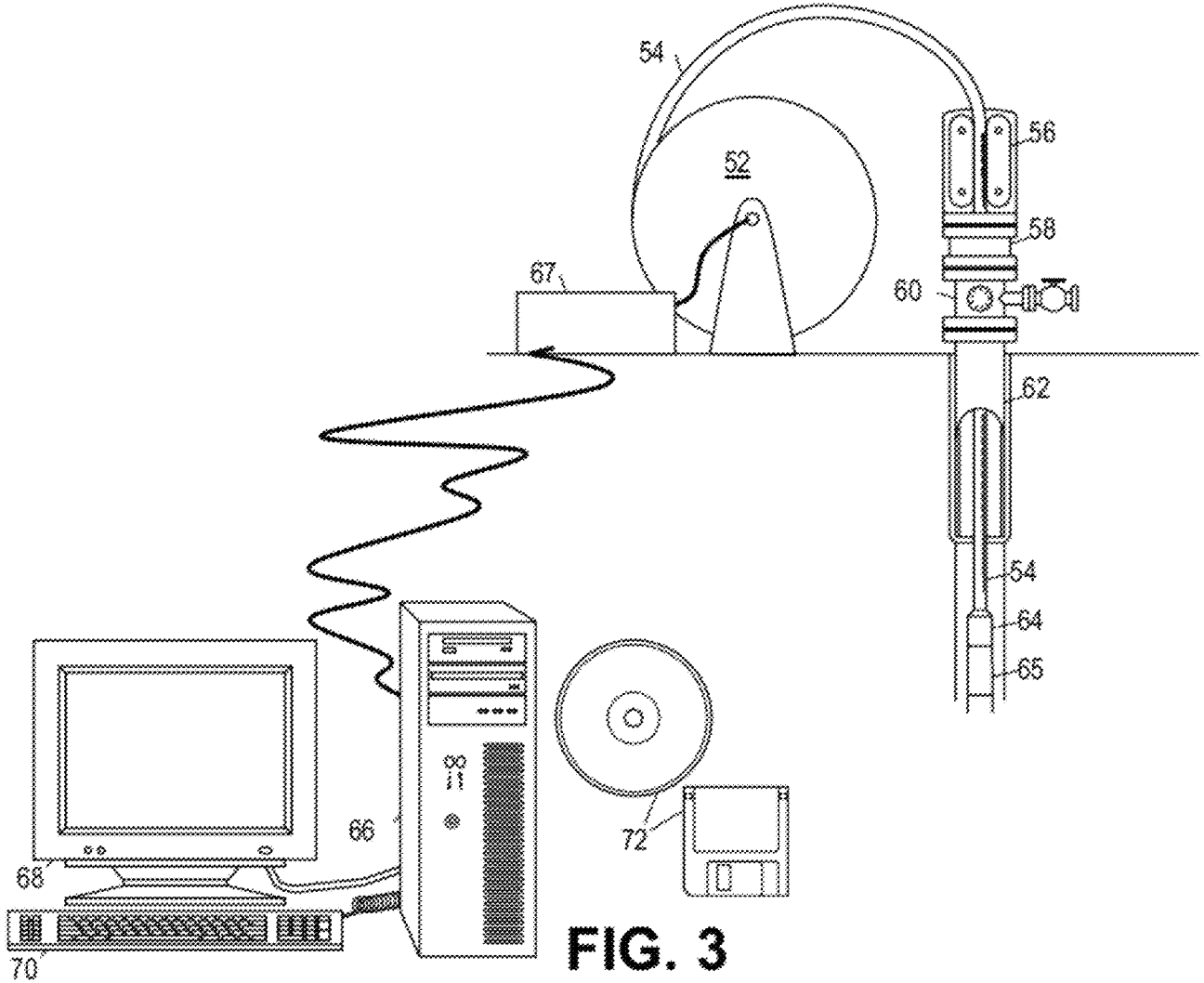
FIG. 3 shows an illustrative environment for logging while drilling with coil tubing.

While the invention is susceptible to various modifications and alternative forms, specific embodiments thereof are shown by way of example in the drawings and will herein be described in detail. It should be understood, however, that the drawings and detailed description are not intended to limit the invention to the particular illustrated embodiments, but on the contrary, the intention is to cover all modifications, equivalents and alternatives falling within the scope of the appended claims.

DETAILED DESCRIPTION

Accordingly, there are disclosed herein various systems and methods for downhole optical imaging while drilling. Such systems and methods enable operators to obtain images and/or video inside the borehole during drilling and/or wireline logging operations. In at least some system embodiments, the image or video data is communicated to the surface in real time to enable operators to better control the drilling operation and steer the drilling assembly. Operators are able to analyze the borehole shape, borehole breakouts, tool offset, fracture patterns, formation texture and composition, bed boundaries, fluid (including gas) inflows, flow patterns, as well as simply monitoring for unusual downhole conditions (e.g., well intersections, whipstock malfunctions, or caverns).

In some embodiments, a downhole optical imaging tool includes a light source and a camera enclosed within a tool body having at least two sidewall windows. A first window transmits light from the light source to a target region in the borehole, while a second window passes reflected light from the target region to the internal camera. As explained in greater detail below, the target region is spaced along the borehole away from the second window in a direction opposite the first window. In some embodiments, this configuration is provided by angling the first and second windows with respect to the sidewall, or by shaping the windows to cast and receive light from a "forward" direction. Some tool embodiments include motion and/or orientation sensors that are employed by a processor to combine separately captured images into a panoramic borehole image.

Some method embodiments include: using a drillstring to convey an optical imaging tool into a borehole containing a fluid; illuminating a target region via a first window in a sidewall of said tool; and capturing an image of the target region via a second window in the sidewall of said tool. The fluid can be, for example, a gas or a substantially transparent liquid. The second window is downhole from the first window, and the target region is downhole from the second window. Images captured by the camera can be used to determine fracture size and orientation, to steer the drill-string, to monitor and optimize a stimulation process, to monitor clean up, to determine tool orientation or position (e.g., relative to a whipstock, muleshoe, multilateral window, or lost string), to operate a downhole device or monitor its operation (e.g., a safety valve, a sliding sleeve, or an isolation device), to monitor downhole tests (e.g., seals during a pressure test), to inspect casing for corrosion, scale buildup, methane hydrate formation, tar accumulation, or even to conduct a milling operation.

The disclosed systems and methods are best understood in the context of the larger systems in which they operate. FIG. 1 shows an illustrative logging while drilling (LWD) environment. A drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As bit 14 rotates, it creates a borehole 16 that passes through various formations 18. A pump 20 circulates drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity. (In some operations, air is used as the drilling fluid.)

A LWD tool 26 is integrated into the bottom-hole assembly near the bit 14. As the bit extends the borehole through the formations, logging tool 26 collects measurements relating to various formation properties as well as the tool orientation and various other drilling conditions. The logging tool 26 may take the form of a drill collar, i.e., a thick-walled tubular that provides weight and rigidity to aid the drilling process. As explained further below, tool assembly 26 includes a downhole video tool that captures images and/or video of the borehole walls. A telemetry sub 28 may be included to transfer images and measurement data to a surface receiver 30 and to receive commands from the surface. In some embodiments, the telemetry sub 28 does not communicate with the surface, but rather stores logging data for later retrieval at the surface when the logging assembly is recovered. In both approaches, limitations are placed on the amount of data that can be collected and stored or communicated to the surface.

At various times during the drilling process, the drill string 8 may be removed from the borehole as shown in FIG. 2. Once the drill string has been removed, logging operations can be conducted using a wireline logging tool 34, i.e., a sensing instrument sonde suspended by a cable 42 having conductors for transporting power to the tool and telemetry from the tool to the surface. A wireline logging tool 34 may have pads and/or centralizing springs to maintain the tool near the axis of the borehole as the tool is pulled uphole. As explained further below, tool 34 can include a downhole video tool that captures video of the borehole walls. A logging facility 44 collects measurements and video data from the logging tool 34, and includes a computer system 45 for processing and storing the measurements gathered by the logging tool.

An alternative drilling technique is drilling with coil tubing. FIG. 3 shows an illustrative coil tubing drilling system in which coil tubing 54 is pulled from a spool 52 by a tubing injector 56 and injected into a well through a packer 58 and a blowout preventer 60 into the well 62. A drill bit is driven by a downhole motor to extend the borehole. The interior well pressure can be kept "underbalanced", i.e., below the pressure internal to the formation, to promote the drilling operation. In the well, a supervisory sub 64 and one or more logging tools 65 are coupled to the coil tubing 54 and configured to communicate to a surface computer system 66 via information conduits or other telemetry channels. An uphole interface 67 may be provided to exchange communications with the supervisory sub and receive data to be conveyed to the surface computer system 66.

Surface computer system 66 is configured to communicate with supervisory sub 64 to set logging parameters and collect logging information from the one or more logging tools 65 such as a downhole video logging tool. Surface computer system 66 is preferably configured by software (shown in FIG. 3 in the form of removable storage media 72) to monitor and control downhole instruments 64, 65. System 66 includes a display device 68 and a user-input device 70 to enable a human operator to interact with the system control software 72.

In each of the foregoing logging environments, the logging tool assemblies preferably include a navigational sensor package that includes directional sensors for determining the inclination angle, the horizontal angle, and the rotational angle (a.k.a. "tool face angle") of the BHA 26. As is commonly defined in the art, the inclination angle is the deviation from vertically downward, the horizontal angle is the angle in a horizontal plane from true North, and the tool face angle is the orientation (rotational about the tool axis) angle from the high side of the wellbore. In accordance with known techniques, wellbore directional measurements can be made as follows: a three axis accelerometer measures the earth's gravitational field vector relative to the tool axis and a point on the circumference of the tool called the "tool face scribe line". (The tool face scribe line is typically drawn on the tool surface as a line parallel to the tool axis.) From this measurement, the inclination and tool face angle of the BHA can be determined. Additionally, a three axis magnetometer measures the earth's magnetic field vector in a similar manner. From the combined magnetometer and accelerometer data, the horizontal angle of the BHA may be determined.

FIG. 4 shows an illustrative downhole imaging while drilling tool 74. Tool 74 can be a drill collar, a coil tubing joint, or a drilling tubular. The tool includes one or more light sources 78 and one or more cameras 80 (FIG. 6) for taking video images or still shots. Tool 74 shields the one or more light sources behind a transparent or translucent window such as sapphire, diamond, or other suitable material that can withstand the temperatures, pressures, and shocks of downhole drilling environment. The light sources can take any of many forms suitable for downhole use, including tungsten filaments, hardened fluorescents, and light-emitting diodes. Suitable light sources include narrow-wavelength light sources, broadband light sources, and light sources in non-visible wavelengths (e.g., infrared or ultraviolet). In any event, the light source is configured to illuminate the video sensor's zone of investigation.

The optical image sensor 80 can include a single sensor that sweeps around the borehole as the tool rotates, or it can include an array of sensors to image around the borehole circumference without requiring any rotation. In some embodiments, the optical image sensors can be paired to provide binocular or 3D vision. Tool 74 shields the optical image sensor(s) with a window that is transparent for at least some of the wavelengths that can be sensed by the sensors.

If desired, the window can be provided curvature to act as a camera lens. In at least some embodiments, the optical image sensor takes the form of a digital camera having, e.g., a charge-coupled device (CCD) sensor. In other embodiments, the optical image sensor employs wavefield sensors that measure light phase and/or direction in addition to light intensity at each point.

Figure 12A:
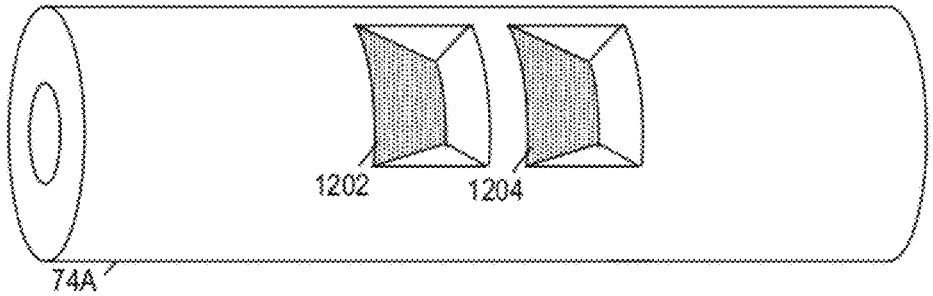
FIGS. 12A-12C show various optical imaging-while-drilling tool embodiments.
Figure 12B:
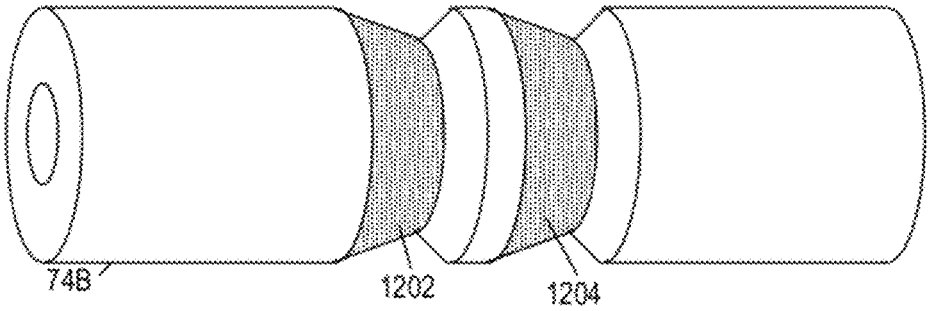

The illustrated tool 74 has the illumination window 1202 and viewing window 1204 (FIG. 12A) angled with respect to the outer wall of the tool body. Such angled windows effectively move the zone of investigation forward (downhole) thereby enabling sidewall windows to "look-ahead" of the window positions at least to a small degree. As shown in FIG. 12A, the angled windows can be localized to a single sector on the tool sidewall, positioned at multiple sectors, or as shown in FIG. 12B, the angled illumination and viewing windows 1202, 1204 can extend all the way around the tool circumference to obviate any requirement for tool rotation.

Figure 12C:
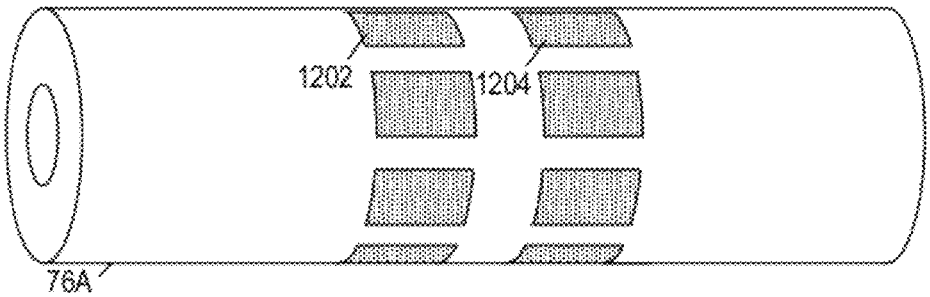

FIGS. 5 and 12C show a second illustrative downhole optical imaging while drilling tool 76 having an array of light sources arranged around the tool circumference and an array of optical image sensors arranged in a similar fashion. Unlike the previous embodiment, the external surfaces of windows 1202, 1204 are parallel to the tool's sidewall. If desired, forward-viewing can be provided with suitable angling of the interior window surfaces. As before, the windows can be localized to a single sector, arrayed across multiple sectors as shown in FIG. 12C, or extended around the tool circumference. Tool 76B can capture images or video of the entire borehole circumference without needing any rotation by the tool 76.

Figure 13A:
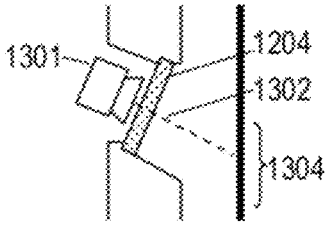
FIGS. 13A-13C show various angled window embodiments.
Figure 13B:
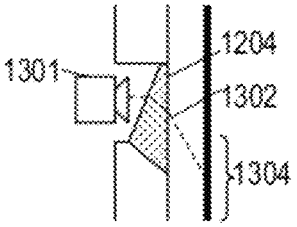
Figure 13C:
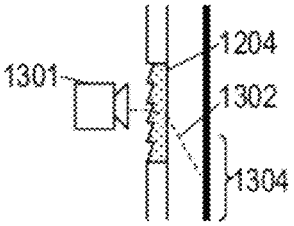

FIGS. 13A-13C show various window configurations that can be used to cast illumination at an angle to the tool's surface and/or view a target region that is downhole from the viewing window. FIG. 13A shows a tilted viewing window 1204 that enables a camera 1301 to view a target region 1304 along an optical path 1302. FIG. 13B shows an alternative embodiment of a viewing window in which the outer surface of window 1204 is parallel (and flush with) the tool wall. However, the inner window surface is tilted to bend the optical path 1302 from the camera 1301 forward to target region 1304. The optical bandwidth and/or material is preferably chosen to keep the index of refraction relatively constant for all optical frequencies. A more constant window thickness can be achieved at the cost of image quality by adopting a Fresnel configuration as illustrated in FIG. 13C. Though shown for viewing windows, such configurations can alternatively or additionally be employed for the illumination windows.

It should be noted that the above disclosed techniques are also applicable to wireline tools. Where rotation is desired, the wireline tool can be fitted with a rotating head. Since wireline tools are coupled to the surface via a cable, fiberoptics can optionally be used to convey light downhole and/or images to the surface.

For use of the foregoing technology, it is helpful for the borehole fluid to be relatively transparent to the light wavelengths in use. In many cases, the borehole fluid includes a large volume fraction of nitrogen, air, natural gas, light oil, or water. It is expected that there will normally be a sufficient quantity of cuttings and/or contrasting fluid phases (e.g., bubbles or droplets) to make the flow patterns of the borehole fluid visible. Nevertheless, a mist or smoke stream can be generated if desired to assist with borehole fluid flow visualization. Conversely, where the borehole fluid is too opaque, a clear fluid can be used to flush the region immediately in front of the sensors to enable imaging.

FIG. 6 shows a block diagram of illustrative tool electronics 90. A power source 92 (such as a battery or a downhole generator) provides power to light source(s) 78 and optical image sensor(s) 80. The optical image sensor(s) provide image data to a capture module 94 which provides preliminary processing (e.g., for image quality control) and image or video compression. A processor 96 accepts the compressed image data for storage in memory 98 and/or uphole transmission via telemetry interface module 100. In at least some embodiments, a video stream is transmitted uphole without delay to make video data available to the operators in real time. In other embodiments, the processor combines images captured at different tool orientations and positions to form a panoramic borehole wall image, which is then compressed and transmitted to the surface.

Figure 7:
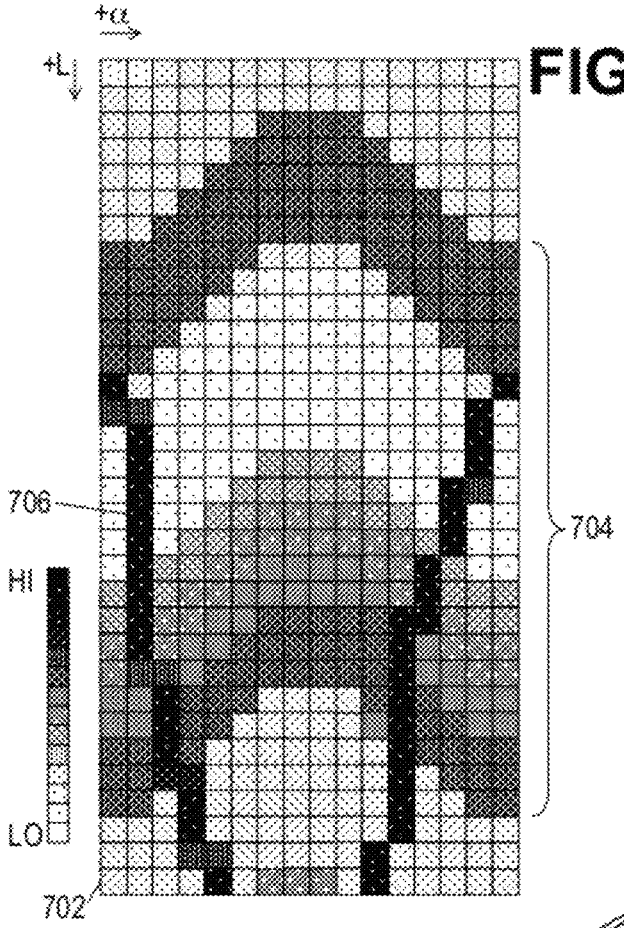
FIG. 7 is an illustrative borehole wall map.

As the downhole optical imaging while drilling tool progresses along the borehole, it rotates or employs an azimuthally-distributed array to collect optical image measurements as a function of azimuth and depth to form a map of the borehole wall as shown in FIG. 7. In many cases, the tool makes many measurements associated with a given portion of the map and averages or combines them in some fashion to obtain the data value that is recorded for that spot. The borehole wall image formed from the captured image data can be, e.g., light intensity, light reflectivity, color, fluorescence, formation composition (e.g., as determined by pattern-matching light spectra to templates for predetermined elements and minerals), distance (e.g., as determined by 3D image processing), fluid flow velocities, etc.

FIG. 7 provides an example of a borehole wall image 702 formed by associating log data with tool position L and rotational orientation $\alpha$. The log data can be displayed as a pixel color and/or a pixel intensity. Such an image often reveals bedding structures (such as structures 704) and fractures (such as fracture 706). Such features often exhibit a sinusoidal dependence on azimuthal angle, indicating that the borehole encountered the feature at an angle other than 90 degrees. (A higher-resolution borehole wall image is shown in FIG. 9.)

Figure 8:
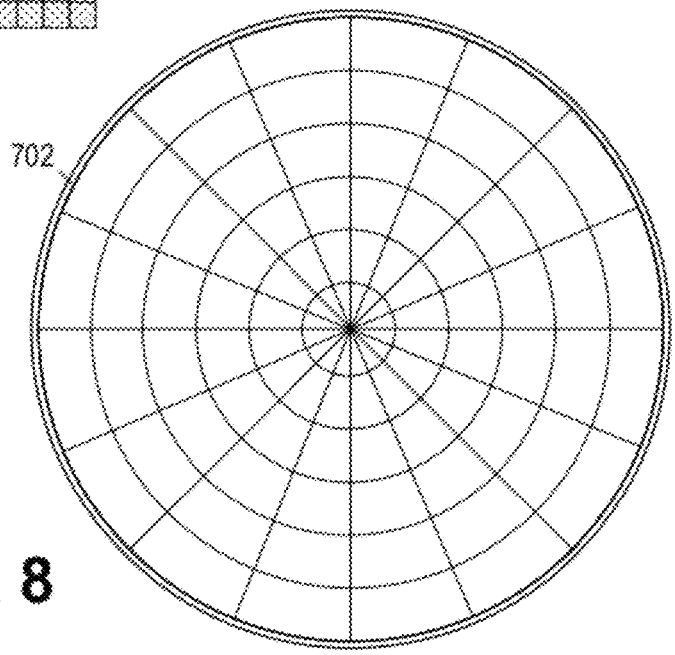
FIG. 8 shows a perspective view of a borehole wall.

FIG. 8 shows an alternative view of the borehole wall map 702. Rather than displaying the map as an "unwrapped" 2D image, the view in FIG. 8 shows the borehole wall map as a view along the axis of a 3D borehole. This view is synthesized from the data gathered by the side-looking optical image sensors, and it can be as simple as a texture-mapped cylinder or as complex as a 3D rendering of the borehole accounting for the actual shape and texture of the borehole wall. FIG. 10 is an example of such a view obtained from actual video data.

It should be noted that the particular utility of the downhole optical image logging tool is not limited to generating a fixed image of the borehole wall. When video data is acquired, the time component of the signal can be used to observe, map, and display inflow and fluid flow patterns in a dynamic format.

FIGS. 11A-11D show illustrative examples of suitable technologies for viewing signals from downhole video tools and/or the images derived therefrom. In FIG. 11A monitor 68 takes the form of a conventional video display on which the video signal is shown either in side view or as a synthesized axial image. Viewing of 3D images is also available. In FIG. 11B, the conventional video display renders a stereoscopic image, with a view for each eye. Viewing glasses 502 can be employed as an aid to exposing the appropriate image to each eye. For example, the left and right views presented on monitor 68 may alternate at (say) 30 Hz, and the lenses in the viewing glasses may alternate in opacity at the same rate. Alternatively, the left and right views may be overlaid, but presented in complementary colors such as red and green, and the lenses of the viewing glasses may be provided with the complementary colors to pass only the appropriate images. As yet another example, the stereoscopic images may be presented side by side on the monitor, and the viewing glasses 502 may be equipped with optics to shift each image into alignment with the appropriate eye. Other stereoscopic technologies exist and may be employed.

For example, in FIG. 11C, display 68 takes the form of display goggles that directly display to each eye the appropriate view of a stereoscopic image. Together the views create a three-dimensional visualization such as the "traveling tube" image 504 shown in broken outline. In a traveling tube image, the viewer can travel back and forth along the borehole axis and perceive visual representations of the formations surrounding the borehole.

In FIG. 11D, a holographic three-dimensional visualization 504 is presented by a holographic projector 505 via a reflector 506. Various projection systems for computer-generated holograms (CGH) are known and may be used. See, e.g., R. I. Young, U.S. Pat. No. 7,161,721, "Computer Generated Holograms", and references cited therein. Holographic projection permits a more natural, less encumbered, viewing experience to the user.

The foregoing technologies enable the operators to view borehole shapes, formation fractures and laminations, and fluid (and gas) influxes into the borehole. Suspended particulates or contrasting fluid phases enable visualization of flow patterns in the borehole. Computer software enables automated mapping of fractures or fluid flow patterns from the video signal stream.

Figure 14:
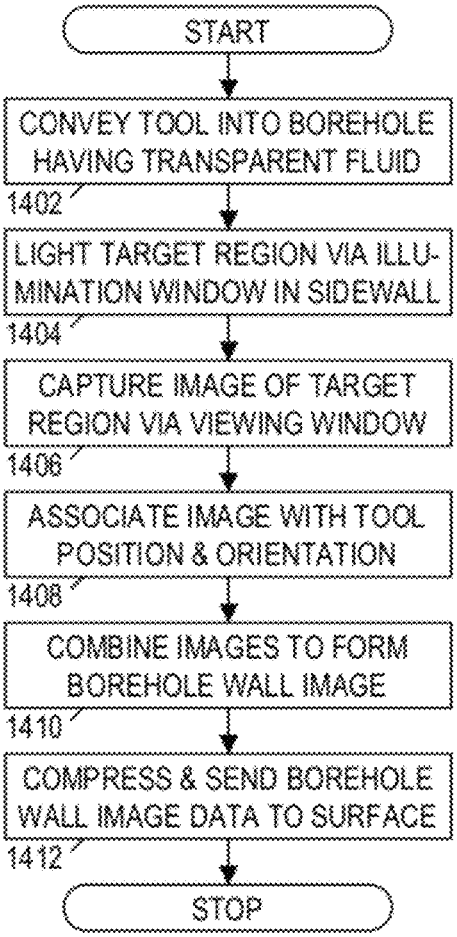
FIG. 14 shows an illustrative downhole optical imaging method.

FIG. 14 is a flowchart of an illustrative downhole imaging method. The method begins in block 1402 with the conveyance of the tool into a borehole having a fluid such as a gas or a substantially transparent fluid. In block a light source illuminates a target region of the borehole wall via an illumination window in the sidewall of the logging tool. In block 1406 the camera captures video or a still image of the target region via a viewing window. In block 1408 the captured images are associated with tool position and/or orientation as provided by the tool's spatial tracking circuitry. In block 1410, the tool combines images from different tool orientations or positions to form a panoramic borehole wall image. In block 1412, the borehole wall image is compressed and transmitted to the surface.

Note that the described tool has a multitude of applications, including imaging borehole wall in terms of the formation heat capacity or cooling rate. If the light source operates in the infrared, the borehole walls will heat slightly when illuminated. By monitoring the time rate of change of the temperature in response to the illumination, information can be learned about the properties of the formation in the target region. In an alternative embodiment, the light source can be cycled on and off, enabling the camera to record both heating and cooling rates. In yet another embodiment, the temperature of the borehole fluid can be cycled up and down to alternately heat and cool the borehole wall. An infrared camera can monitor the temperature versus time for each "pixel" in the borehole wall image to estimate at least a qualitative heat capacity or thermal conductivity of the formation.

Numerous variations and modifications will become apparent to those skilled in the art once the above disclosure is fully appreciated. For example, the illumination window and viewing window could be at different angles, or only one might be angled, or they could even be angled towards each other to image a target region between them. It is intended that the following claims be interpreted to embrace all such variations and modifications where applicable.

What is claimed is:

1. An optical imaging tool for downhole use, the tool comprising:
- a light source;
- a camera; and
- a tool body having a sidewall with:
- a first window that transmits light from the light source to a target region in a borehole; and
- a second window that passes reflected light from the target region to the camera, wherein the target region is downhole from the second window.

2. The tool of claim 1, wherein at least one of the first and second windows has an outer surface that is angled with respect to the sidewall.

3. The tool of claim 1, wherein the second window has an inner surface that is tilted relative to the sidewall.

4. The tool of claim 1, wherein the tool body is mounted on a drill string.

5. The tool of claim 4, wherein the drill string comprises coil tubing.

6. The tool of claim 1, wherein the tool body is suspended from a wireline.

7. The tool of claim 1, wherein the light source operates in at least one of the spectra in the group consisting of: infrared light, visible light, and ultraviolet light.

8. The tool of claim 1, further comprising:
- a tool motion or orientation sensor; and
- a processor coupled to the sensor and the camera to combine multiple images into a panoramic borehole image that is compressed and transmitted to the surface.

9. A method for imaging while drilling, the method comprising:
- using a drillstring to convey an optical imaging tool into a borehole containing a fluid;
- illuminating a target region in a borehole via a first window in a sidewall of said tool; and
- capturing an image of the target region via a second window in the sidewall of said tool, wherein the second window is downhole from the first window, and wherein the target region is downhole from the second window.

10. The method of claim 9, wherein at least one of the first and second windows has an outer surface that is angled with respect to the sidewall.

11. The method of claim 9, wherein the second window has an inner surface that is tilted relative to the sidewall.

12. The method of claim 9, further comprising:
- combining multiple captured images to form a panoramic image; and
- transmitting a compressed representation of the panoramic image uphole.

13. The method of claim 12, wherein said combining includes tracking tool motion and relating the multiple images based at least in part on said motion.

14. The method of claim 9, further comprising determining fracture size and orientation based at least in part on said captured image.

15. The method of claim 9, further comprising steering the drillstring based at least in part on said captured image.

16. The method of claim 9, further comprising adjusting a parameter of a stimulation process based at least in part on said captured image.

17. The method of claim 9, further comprising conducting a milling operation based at least in part on said captured image.

18. The method of claim 9, wherein the fluid is a gas or a transparent liquid.

19. An optical imaging tool for downhole use, the tool comprising:

a tool body having a sidewall with at least one viewing window; and a camera positioned within the tool body, wherein the camera captures images of a target region in a borehole downhole from the at least one viewing window.

20. The tool of claim 19, further comprising at least one light source inside the tool body that illuminates the target region via an illumination window in the sidewall, wherein the illumination window is positioned uphole from said at least one viewing window.

21. The tool of claim 20, wherein said at least one viewing window has parallel surfaces that are inclined relative to the sidewall.

22. The tool of claim 20, wherein said at least one viewing window has an inner surface that is not parallel to the sidewall.

23. The tool of claim 19, further comprising a second camera paired with the first camera to provide binocular three-dimensional images.

24. The tool of claim 19, further comprising a processor coupled to the camera, wherein the processor measures temperature variation with respect to time.

25. A downhole logging method that comprises:

using a camera to collect measurements indicative of borehole wall temperature;

processing the measurements to determine rates of temperature change; and displaying a borehole wall image based at least in part on measured rates of temperature change.

26. The method of claim 25, wherein pixel values of the borehole wall image represent rates of temperature change.

27. The method of claim 25, wherein pixel values of the borehole wall image represent heat capacity.

28. The method of claim 25, further comprising heating or cooling a borehole fluid to cause changes in the borehole wall temperature.

29. The method of claim 25, further comprising illuminating the borehole wall with an infrared source to cause changes in the borehole wall temperature.

* * * * *